US006962017B1

(12) United States Patent
Pounds

(10) Patent No.: US 6,962,017 B1
(45) Date of Patent: Nov. 8, 2005

(54) FRAMING SYSTEM FOR SECURING AND DISPLAYING FLAT SHEET MATERIALS

(76) Inventor: Stephen T. Pounds, 362 W. Marshall, Ferndale, MI (US) 48220

( * ) Notice: Subject to any disclaimer, the term of this patent is extended or adjusted under 35 U.S.C. 154(b) by 0 days.

(21) Appl. No.: 09/937,528

(22) PCT Filed: Mar. 24, 2000

(86) PCT No.: PCT/US00/08171

§ 371 (c)(1),
(2), (4) Date: Jan. 29, 2002

(87) PCT Pub. No.: WO00/57389

PCT Pub. Date: Sep. 28, 2000

Related U.S. Application Data

(60) Provisional application No. 60/125,865, filed on Mar. 24, 1999.

(51) Int. Cl.[7] ..... A47G 1/06
(52) U.S. Cl. ..... 40/781; 40/791
(58) Field of Search ..... 40/706, 707, 777, 40/780, 781, 782, 785, 790, 791, 591; 206/575

(56) References Cited

U.S. PATENT DOCUMENTS

| | | | |
|---|---|---|---|
| 1,463,150 | A | 7/1923 | Carlsen |
| 2,823,478 | A | 2/1958 | Östergaard et al. |
| 4,294,348 | A | 10/1981 | Hastings |
| 4,413,035 | A | 11/1983 | DiIoia |

*Primary Examiner*—Joanne Silbermann
(74) *Attorney, Agent, or Firm*—Reising, Ethington, Barnes, Kisselle, P.C.

(57) ABSTRACT

A peripheral framing system for mounting and displaying a poster or other sheet material. The framing system requires no rigid backing since the framing elements themselves serve to support the poster or other displayed object. The system is comprised of a base structure, a clamping structure and, if desired, a protective translucent covering. The base structure includes several elongated frame members, each of which extends between a pair of angled ends. The ends of adjacent base frame members join together by means of a mortise and tenon to form a rectangular base frame when assembled. The clamping structure comprises several clamping members, one for each of the frame members, with each of the clamping members having a plurality of pegs. The base frame members, translucent cover, and displayed object each have an equal number of holes to receive the pegs. The holes in the base frame members are used to receive and secure the complementary pegs to thereby retain the translucent cover and displayed object in place between the clamping members and base frame members. Thus, during assembly, the displayed object and translucent covering are laid flat on the assembled base frame with their clearance holes aligned with the holes in the frame members. Then, the clamping structure is brought down into place. The clamping structure therefore fastens the displayed object and protective cover securely into place. The result is a frame which displays and protects an object without the need for a rigid backing. Also disclosed is a protective canister capable of transporting and storing the entire framing system. The protective canister comprises a translucent tube with endcaps and is capable of containing the disassembled framing system, the displayed object and the translucent covering. In this manner, the protective canister provides convenient and efficient means in which to store the entire system when it is not being displayed.

51 Claims, 6 Drawing Sheets

FIG-1
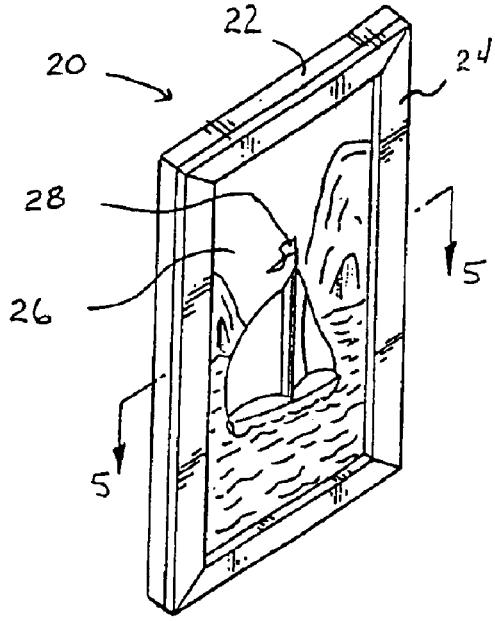
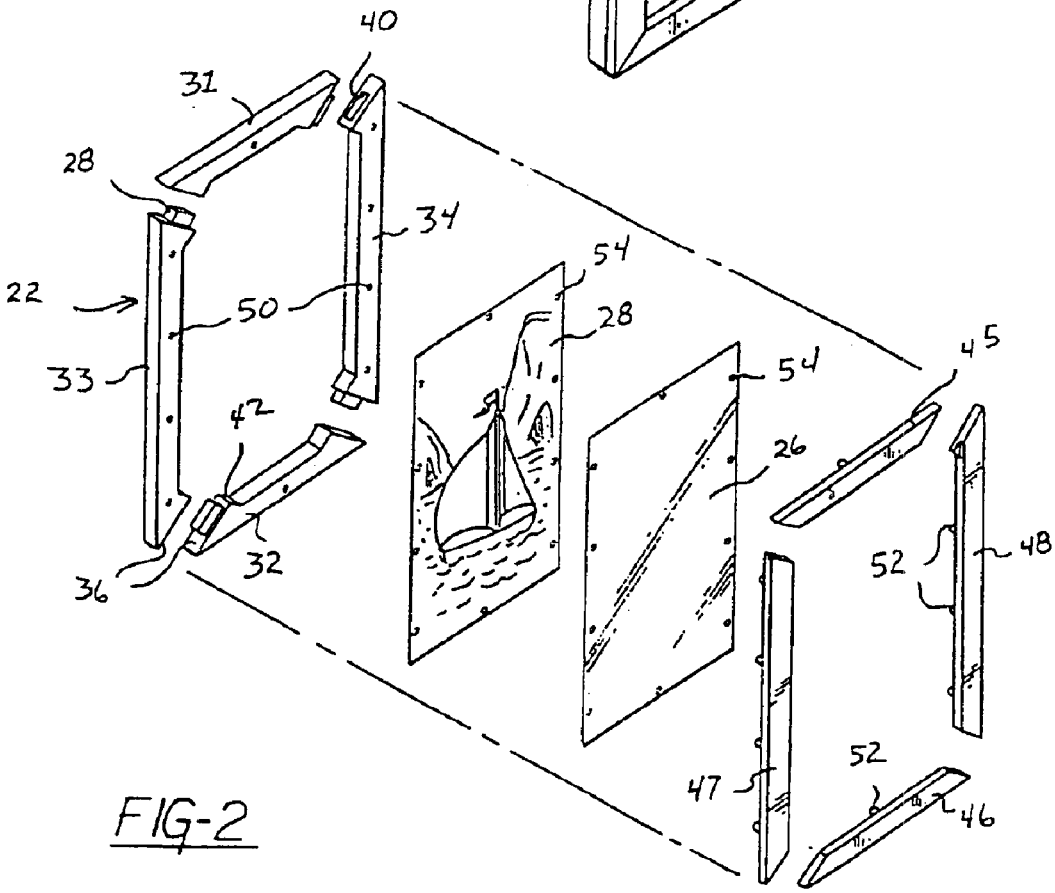
FIG-2

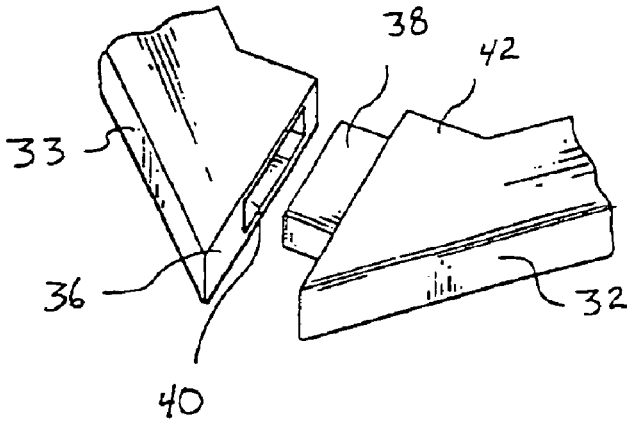
FIG - 3
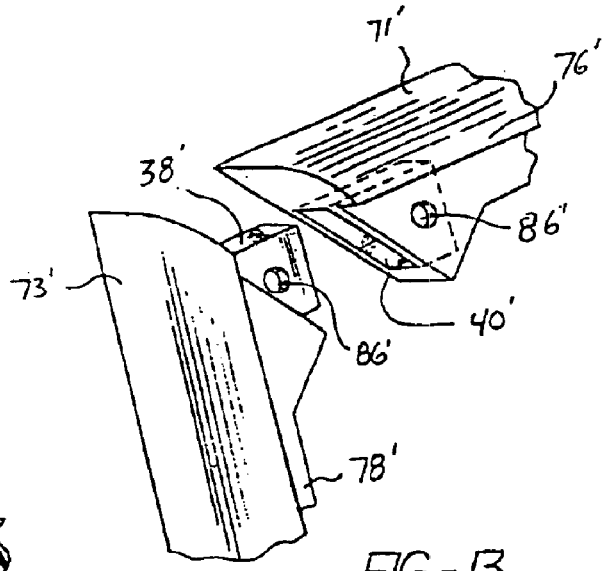
FIG - 13
FIG - 4
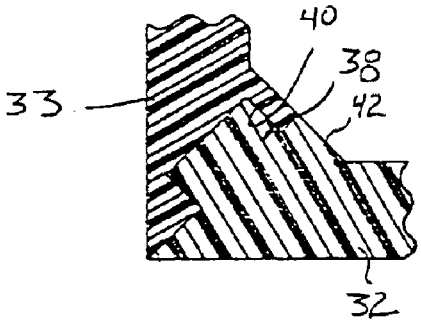
FIG - 5
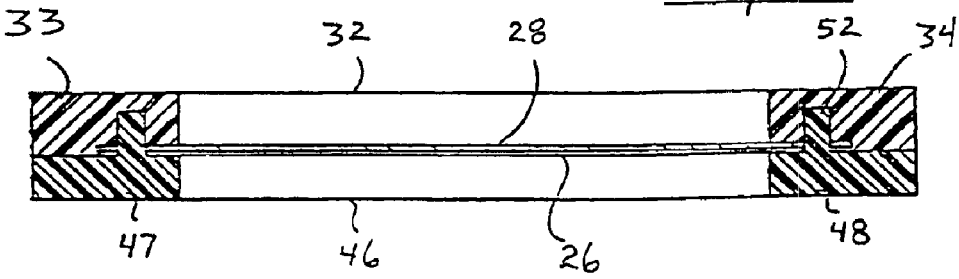

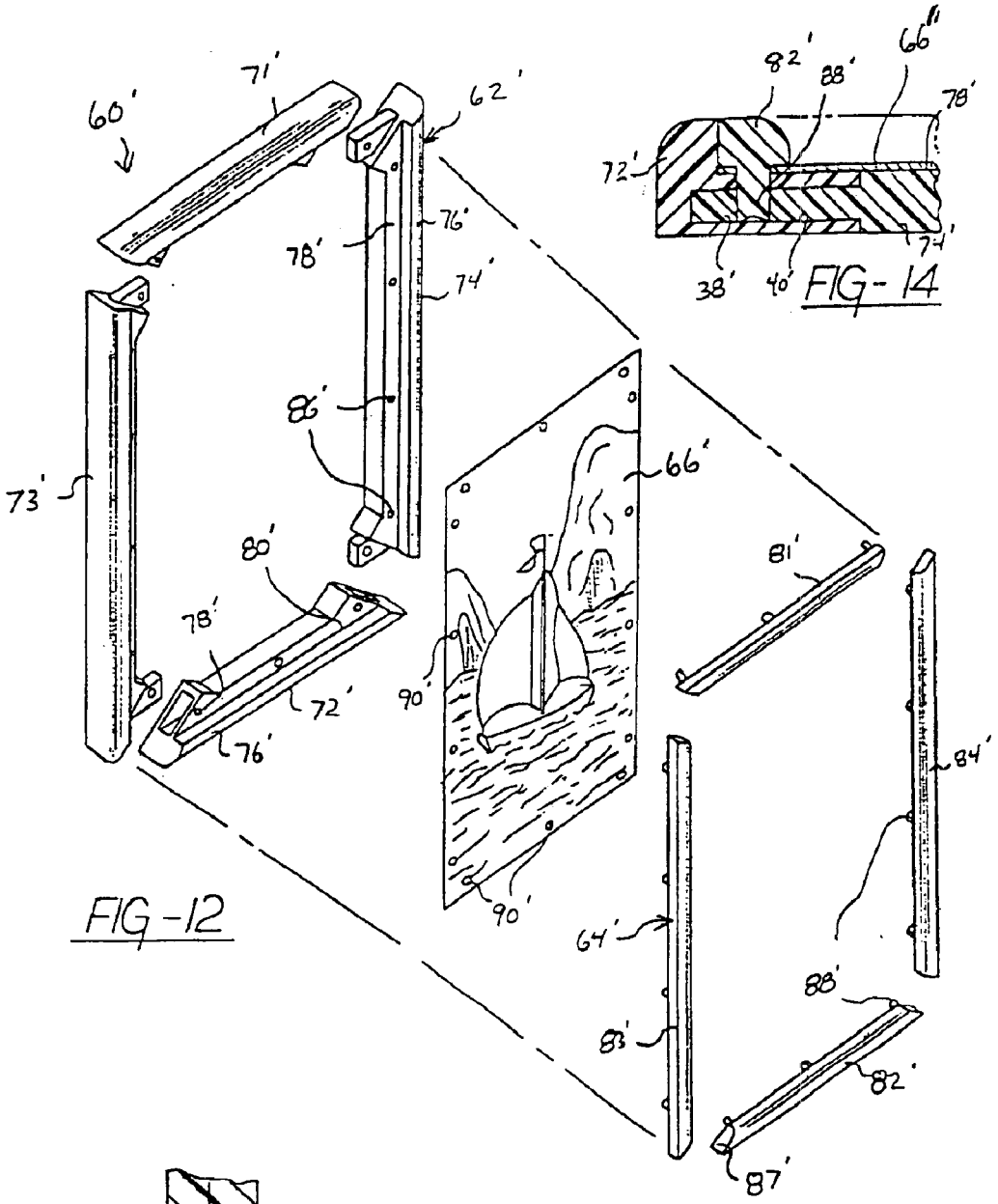
FIG-12
FIG-14
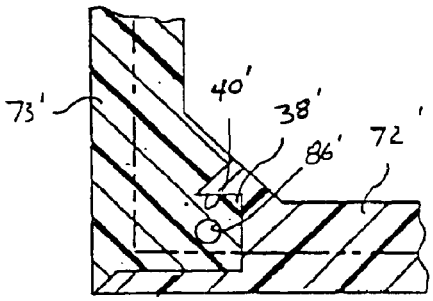
FIG-15

FRAMING SYSTEM FOR SECURING AND DISPLAYING FLAT SHEET MATERIALS

This application claims benefit of provisional application 60/125,865 filed Mar. 24, 1999.

TECHNICAL FIELD

The present invention relates to a framing system for mounting and displaying thin-flat sheet materials, such as posters or the like. Further the present invention relates to a kit including the framing system and a poster.

BACKGROUND OF THE INVENTION

Typically, poster or other sheet materials are sold in stores without any frames. It is sometimes difficult to provide an adequate frame for such a poster that is relatively compact and easy to assemble.

Frames for posters are known in the art. For example, such frames are shown in U.S. Pat. Nos. 5,515,629; 4,986,013; 4,512,095; 4,176,480; and 4,129,953. The prior art does not provide a framing system that is simple to assemble and disassemble.

It is desirable to provide a frame that can easily be assembled and disassembled. With this type of system, the framing system can be marketed and delivered to a buyer in such a manner so as to require very little space. Further, the fame system can be assembled without the need for any tools. It is also desirable to provide a kit including a package having the faming system therein and also including the thin flat sheet material, such as a poster which is to be secured and displayed by the frame.

SUMMARY OF THE INVENTION

According to the present invention, there is provided a frame system for mounting or displaying a poster or other sheet material. The system comprises a plurality of frame members adapted to be secured together to form a base structure. The system further comprises a plurality of separate clamping members adapted for independent detachable connection with the base structure to retain the poster between the base structure and the clamping members.

It is an object of the present inventions to provide a frame system for mounting and displaying a poster that can easily be assembled and which when unassembled requires relatively little space.

It is a further object of the present invention to provide a frame system having clamping members that are detachable from the base structure to retain the poster or sheet material between the clamping members and the base structure.

It is a further object of the present invention to provide a frame system that is easily to assemble and does not require a rigid backing member.

It is a further object of the present invention to provide a frame system that is easily to assemble and does not require any tools in the assembly process.

It is a further object of the present invention to provide a kit including a container, frame members, clamping members and the sheet material, which kit is compact, allowing for easy marketing or storage.

BRIEF DESCRIPTION OF THE DRAWINGS

A preferred exemplary embodiment of the present invention will hereinafter be described in conjunction with the appended drawings, wherein like designations denote like elements, and:

FIG. 1 is a perspective view of a first embodiment of a framing system of the present invention;

FIG. 2 is an exploded, perspective view of the framing system of FIG. 1;

FIG. 3 is a perspective view of adjacent ends of the framing members of FIG. 1 showing the mortise and tenon joint between the frame members;

FIG. 4 is a cross-sectional view of the assembled mortise and tenon joint of FIG. 3;

FIG. 5 is a cross-sectional view taken along the 5—5 line of FIG. 1;

FIG. 12 is an exploded, perspective view of another alternate embodiment of the framing system;

FIG. 13 is a perspective view of adjacent ends of the framing members of FIG. 12 showing the mortise and tenon joint between the frame members;

FIG. 14 is a cross sectional view of the assembled frame members of the frame system of FIG. 12; and FIG. 15 is a cross-sectional view of the assembled mortise and tenon joint of FIG. 13.

DESCRIPTION OF THE PREFERRED EMBODIMENTS

Figure 6:
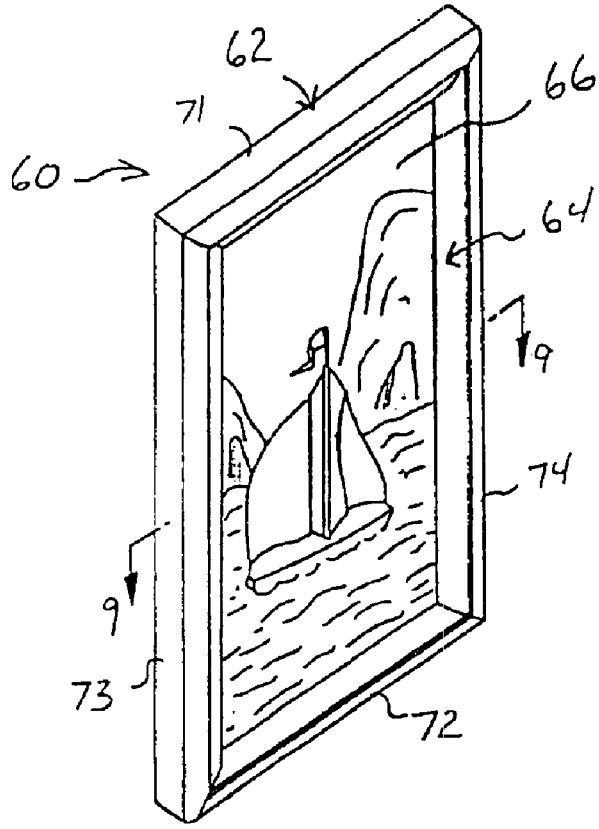
FIG. 6 is a perspective view of a second embodiment of a framing system of the present invention.

Referring first to the embodiment of FIGS. 1–5, and in particular to FIG. 1, there is shown a framing system 20 that comprises a base structure 22, a clamping structure 24, and a translucent, protective covering 26, all of which can be assembled together to mount and display a poster or other sheet material 28.

Referring now also to FIG. 2, the base structure 22 comprises four elongated frame members 31–34. Poster 28 has a rectangular shape, and therefore two of the frame members will be greater in length than the remaining two. Each frame member 31–34 extends linearly between a pair of inwardly angled ends 36. Each angled end 36 fits together with an adjacent, complementary end 36 to form a right angle, as can be seen in FIGS. 3 and 4. The frame members are secured into their right angle arrangement by means of a tenon 38 which mates with a mortise hole 40 in the adjacent frame member. It should be noted that the outer periphery retains a sharp right angle, while the inner periphery is tapered (as indicated at 42) for increased structural cohesion. This mortar and tenon joint is capable of preserving the structural rigidness needed in the absence of a solid backing. The top surfaces of the frame members thus provides flat front surfaces on which the poster or other sheet material is secured.

The clamping structure 24 comprises four clamping members 45–48 that clamp the translucent cover 26 and poster (or other displayed object) 28 between the clamping members and base frame members. Each of the frame members 31–34 has one or more receiving holes 50. These receiving holes are capable of receiving and securing complementary clamping pegs 52 which extend downward from the clamping members, as seen in FIGS. 2 and 5. Once assembled, the base structure 22 provides a rigid framework which supports and retains the translucent cover 26 and displayed object 28 in place.

In addition to receiving holes 50 in the base frame members 31–34, both the translucent covering 26 and displayed object 28 have a plurality of complementary clearance holes 54. In this layered manner, the assembled base structure 22 is placed first with its receiving holes 50 upwardly exposed. The displayed object 28 is laid on top of the base structure 22 so that all of its clearance holes 54 line up with the receiving holes 50. The translucent protective covering 26 is laid on top of the displayed object 28 in a similar manner. Lastly, each clamping member 45–48 is placed onto its corresponding frame member 31–34. The clamping pegs 52 then pass through the aligned holes 54 of the protective covering and the display object, and are press fit into the receiving holes 50 in the frame members. In this manner, the base structure 22 and clamping structure 24 together firmly clamp the two thin objects into place, as can be seen in FIG. 5.

Figure 7:
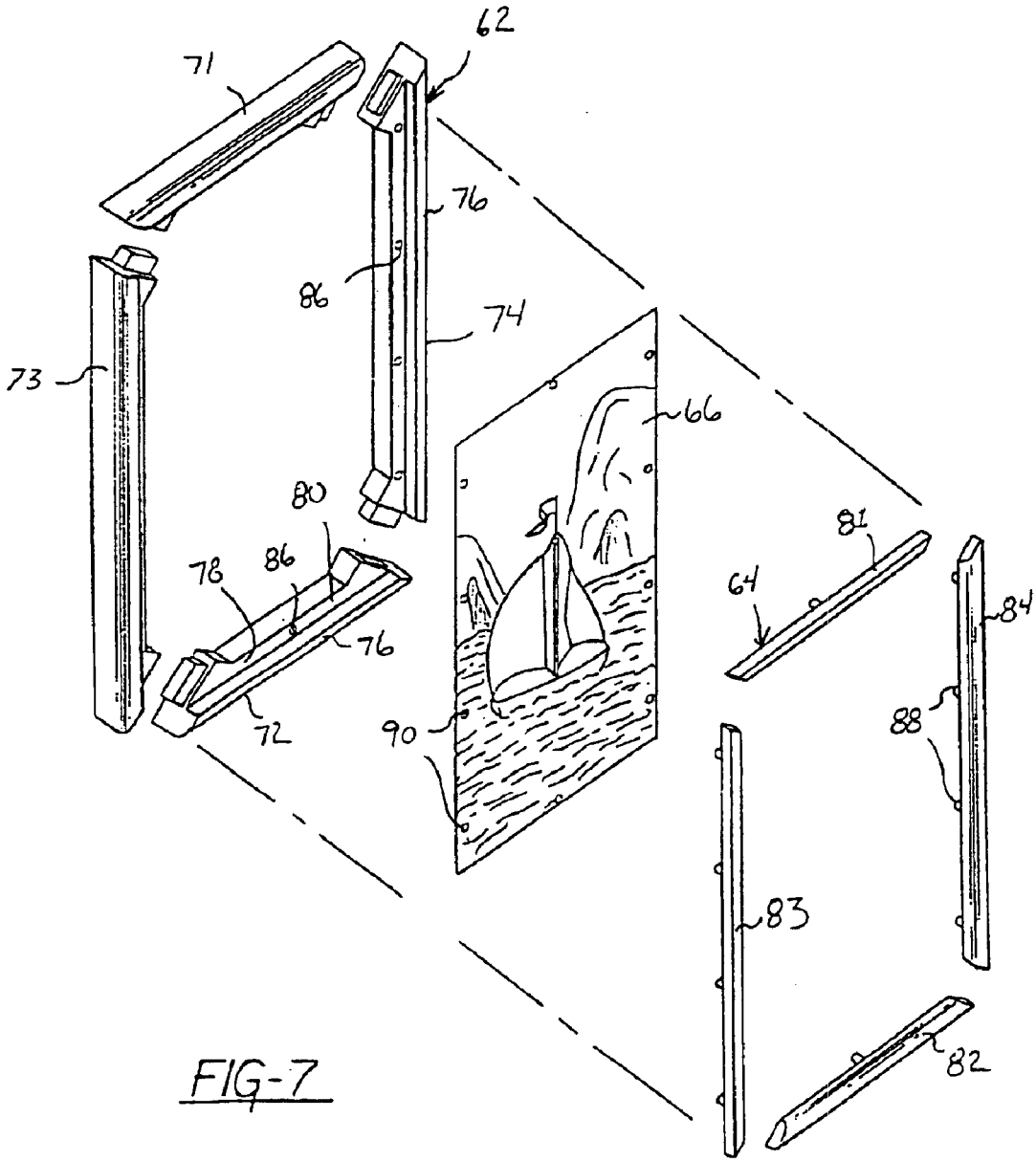
FIG. 7 is an exploded, perspective view of the framing system of FIG. 6.

Tuning now to FIGS. 6–9, there is shown a second embodiment which is similar to the first embodiment, except that no protective cover is used and the clamping members snap into channels formed in the frame members. In particular, the framing system 60 shown in FIG. 6 includes a base structure 62 and clamping structure 64 that snap together to mount and retain a displayed object 66 in place. As depicted in FIG. 7, the base structure 62 is formed from frame members 71–74, each of which has a unitary extended shoulder 76 that, together with a ledge 78 of the frame members, forms a channel 80 running the length of each frame member. The ledge 78 provides a flat front surface for receiving the poster or other sheet material. The clamping structure 64 is formed from four smaller clamping members 81–84 that can have a cross-sectional shape similar to quarter-round or shoe molding. The clamping members have mitered ends 86 and are sized to fit into the channels 80 of the frame members.

As in the first embodiment, the frame members 71–74 each have one or more holes 86 that received corresponding pegs 88 extending from the backside of the clamping members 81–84. The displayed object has corresponding clearance holes 90 through which the pegs 88 extend.

When the base structure 62 is assembled, the displayed object 66 can simply be laid onto the ledges 78 and the shoulder portions 76 of the assembled frame members will help align the receiving holes 90 of the displayed object 66 with the receiving holes 86 of the frame members. This simplifies assembly for the user.

Figure 10:
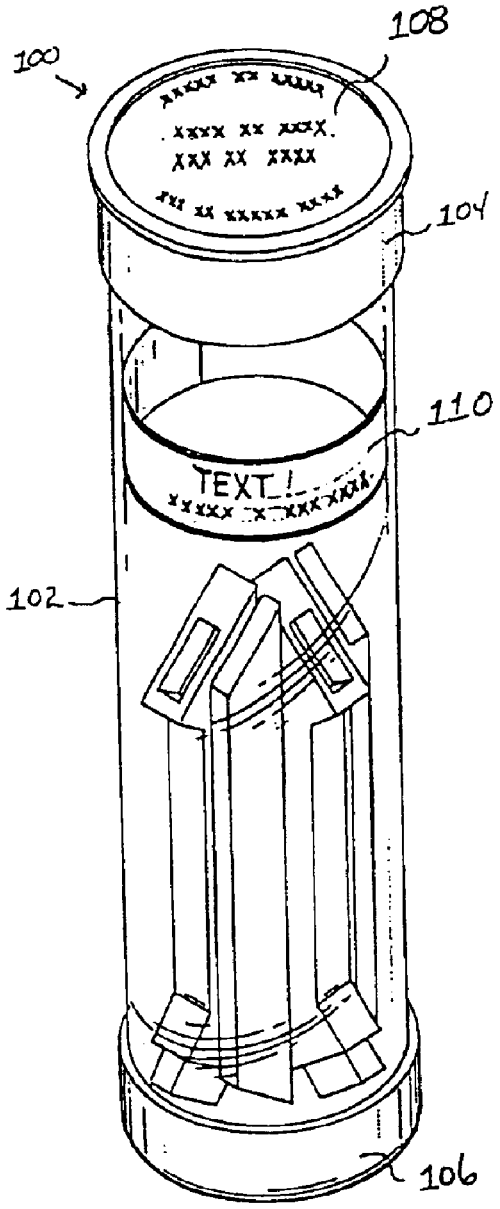
FIG. 10 is perspective view of a first embodiment of a protective canister of the invention, showing certain parts of the framing system of FIG. 1 enclosed therein.

FIG. 10 depicts the individual components of a first embodiment of a protective canister assembly 100 of the present invention. Protective canister 100 comprises several components: the canister body 102, canister endcaps 104 and 106, and identifying labels 108 and 110. The canister body 102 is a generally rigid, translucent, cylindrical tube that is open at each end. The canister body 102 is preferably constructed of a durable, translucent plastic. This allows the contents of the canister (and in particular the displayed object) to be easily identified while also being protected. The canister body has a diameter which is large enough to avoid overly constricting the rolled contents. In addition, it's diameter must be able to accommodate the disassembled base structures 12, 62 and clamping structures 14, 64. If the diameter is too narrow, the contents will be rolled too tightly or will crush the framing and clamping members into the displayed object, possibly causing creases, tears or other permanent damage. The diameter will be dictated by the general size of its contents. The cylinder 102 must have a minimal length equal to or greater than the longest dimension of its contents, which will generally be the longer base frame members.

The endcaps 104, 106 are also of a durable plastic material, but are not translucent. The endcaps slide over top of the canister body 102, and therefore require a diameter slightly larger than the canister. Endcaps which fit into, as opposed to over top of, the canister body could possibly crush the edges of the contents and are not preferred. The endcaps slide over top of the canister until they are obstructed from sliding further due to the rigid circular backing attached to the back of each endcap. Once in place, the endcaps in combination with the cylinder will enclose the contents and prevent them from sliding out.

Figure 11:
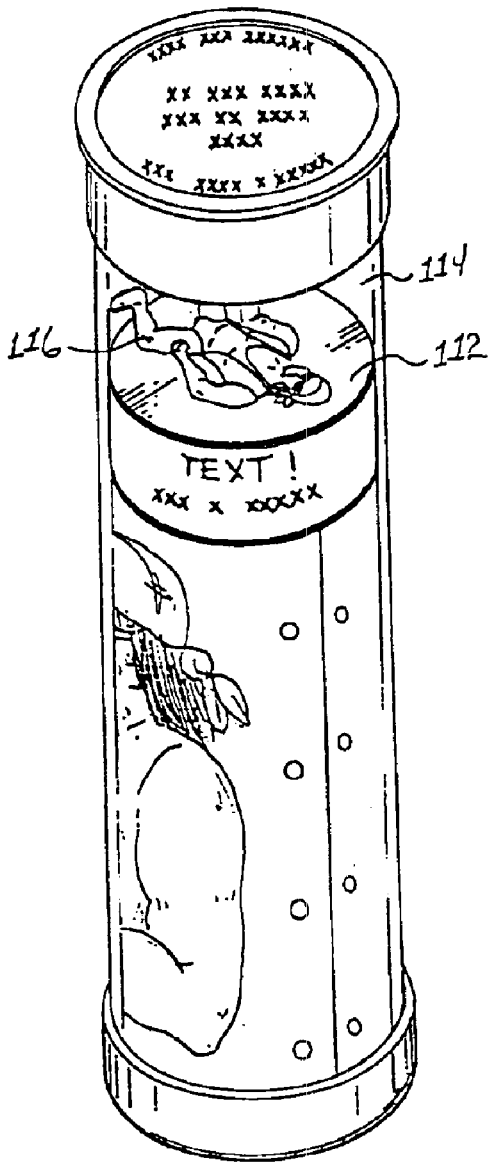
FIG. 11 is a perspective view of a second embodiment of a protective canister of the invention, showing certain parts of the framing system of FIG. 1 enclosed therein.

Referring to FIG. 11, there is shown a second embodiment of a protective canister of the invention. This embodiment is similar to that of FIG. 10, except that it includes a stopper 112 on the inside of the canister, towards the top. This stopper 112 is similar to an endcap, but is designed to fit on the inside of the canister. The stopper has a slightly smaller diameter than the inside diameter of the canister body to provide a tight fit. The stopper rests on top of the contents of the canister and creates a separate volume 114 between the contents and the top endcap. Since the longest object within the canister will be the longest base frame member, there is no worry of damaging the rolled displayed object. This volume 114 can be used to store and display memorabilia or other objects desired by the user. For example, if the displayed object were a baseball related poster, it would be appropriate to put a memorabilia baseball within the confined volume. Similarly, an action figure 116 can accompany a superhero poster. In this embodiment, the protective canister would remain the same, with the exception of the stopper and perhaps a lengthened canister body, to accommodate the addition of the confined volume 114.

FIGS. 12 through 14 show another embodiment which is similar to the second embodiment except that the mortise and tenons are slightly modified. Specifically, as can be seen in FIG. 12, framing system 60' shown in FIG. 12 includes a base structure 62' and clamping structure 64' that snap together to mount and retain a displayed object 66' in place. As best seen in FIG. 12, the base structure 62' includes two side frame members, 73', 74', a top frame member 71' and a bottom frame member 72'. Each of the frame members has a unitary extending shoulder 76' that, together with a ledge 78' of the frame members 71'–74' forms a channel 80' running the length of each frame member. The ledge 78' provides a flat front surface for receiving the poster or other sheet material.

The clamping structure 64' is formed from four smaller clamping members 81'–84' that can have a cross-sectional shape similar to quarter-round or shoe molding. The clamping members 81'–84' have mitered ends 87' and are sized to fit into the channels 80' of the frame members 71'–74'.

As with the second embodiment, the frame members 71'–74' each have one or more holes 86' that receive corresponding pegs 88' extending from the backside or underside of the clamping members 81'–84'. The displayed object has corresponding clearance boles 90' through which the pegs 88' extend. Securing of the poster or other sheet material is as discussed above.

In the first two embodiments discussed above, the mortise and tenons have a configuration such that each frame member 31–34 and 71–74 has a mortise 40 on one end thereof an a tenon 38 on the other end thereof. Complementary ends of the frame members are aligned and the respective frame members are secured into right angle arrangement by means of inserting the tenon 38 in the corresponding mortise 40.

Figure 8:
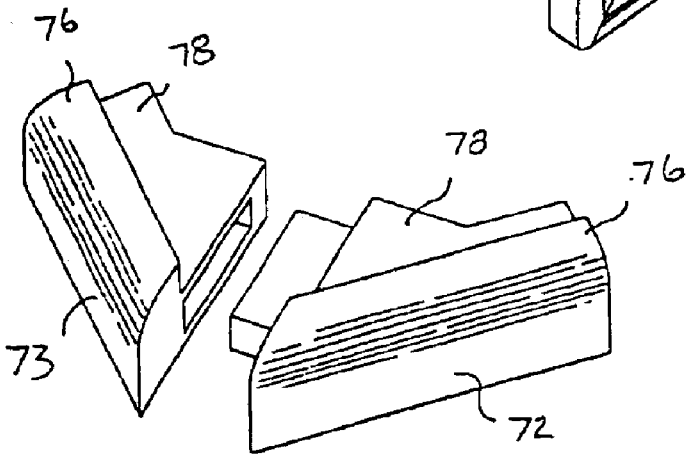
FIG. 8 is a perspective view of adjacent ends of the framing members of FIG. 6 showing the mortise and tenon joint between the frame members.
Figure 9:
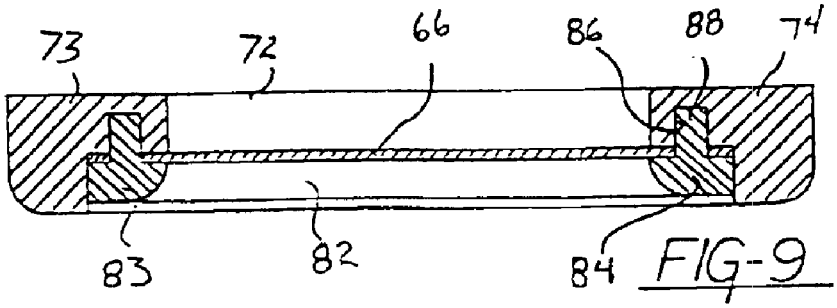
FIG. 9 is a cross-sectional view taken along the 9—9 line of FIG. 6.

Further, as shown best in FIGS. 3 and 8, the tenon 38 and mortise 40 each extend generally in the same direction as the angled end 36 of the frame member. This arrangement is best seen in FIG. 4. As seen, the tenon 38 extends outwardly and generally perpendicularly from the angled surface of the end 36 of the frame member. Similarly, the mortise extends inwardly and generally perpendicularly from the angled surface 36 of the adjacent frame member.

In the alternate embodiment of FIGS. 12–14, the tenon 38' and mortise 40' joint is slightly modified. First, tenons 38' are each located on the same frame member. As shown, the tenons 38' are located on the side frame members 73', 74'. The mortises are each located on the top and bottom side frame members 71', 72', respectively. It will be appreciated, however, that the tenons 38' could be located on the top 71' and bottom 72' side frame members and the mortises on the side frame members 73', 74'.

Further, the tenons 38' and mortises 40' extend at an angle relative to the angled surface of the end of the frame member. As best seen in FIG. 15, the tenon 38' extends in a direction generally perpendicularly to the axis of the side frame member 73'. The corresponding mortise extends generally parallel to direction of the complementary bottom side frame member 72'. When the tenon 38' is secured in the mortise 40', the frame members are secured to form right angles as in the first and second embodiments discussed above.

As with the first two embodiments described above, the clamping members 81'–84' are retained in position only by their connection to the base frame members via the pegs 88' and corresponding holes 86'. That is, the clamping members 81'–84' are independent members and preferably do not interconnect at their respective ends. The respective ends of the clamping members 81'–84' are mitered so as to provide a relatively tight fit between adjacent ends of the clamping members 81'–84'. Thus, the clamping members in each of the embodiments are detachably connected to the base frame members. With the clamping members configured in this manner, there is provided a quick and simple way of framing a poster. Because the clamping members are detachable, the framing system can easily be dismantled and stored in a relatively small space. Similarly this arrangement allows for the poster to easily be changed.

Also, as best viewed in FIGS. 12 and 14, the tenon 38' and mortises 40' may each include a receiving hole 86' therethrough for receiving a clamping peg 88' on the respective clamping member. With a connection made in this manner, the clamping members 81'–84' serve the further purpose of securing adjacent frame members together. It will be appreciated that while not specifically shown in the figures, this arrangement can also be used with the first two embodiments described above.

It should be noted that the invention could be implemented in a number of different ways that will be apparent to those skilled in the art. For example, the pegs could be placed on the frame members and the receiving holes on the clamping members. Alternatively, the pegs and holes can alternate on the respective frame member and clamping member. Further, a protective cover can be used in any of the embodiment discussed above. Further, magnetic strips could be used to replace the pegged clamping members, with each magnetic strip being attached to one of the extended ledges opposite a metal strip or complementary magnetic strip located on the corresponding clamping member. Also, a different type of jointing system could be used to secure the right angle corners. For example, the corners can comprise dove tail joints that can be assembled and disassembled by sliding the dovetails of one frame member into and out of engagement with the corresponding dove tails of the adjacent frame member. As will now be appreciated, the framing system described herein provides a frame structure without the need for a solid backing, and provides a canister arrangement for packaging and subsequent storage of the framing system and displayed object.

What is claimed is:

1. A framing system comprising:

frame members adapted to be secured together to form a base structure, said frame members being detachably connectable together such that they can be connected to each other to form said base structure as an open frame and can be subsequently disassembled by disconnecting said frame members from each other;

a clamping structure adapted for engagement with said base structure to retain the sheet material therebetween, said clamping structure including a plurality of individual clamping members that attach to said frame members, said clamping structure further including pegs on one of said frame members and said clamping members and corresponding receiving holes on the other of said frame members and said clamping members, said receiving holes being adapted to receive said pegs to retain the sheet material between said clamping members and said frame members, and a sheet material adapted for disposition between said frame members and said clamping members, said sheet material including a plurality of holes therethrough at the periphery thereof for receiving said pegs to thereby secure said sheet material between said frame members and said clamping members.

2. A system as set forth in claim 1 wherein said base structure comprises four frame members, each of said frame members extending between a pair of inwardly angled ends, and each of said angled ends adapted to be connected to an adjacent complementary end of another of said frame members.

3. A system as set forth in claim 2 wherein some of said ends of said frame members include a tenon and others of said ends of said frame members include a mortise, and wherein said frame members can be interconnected to form a rectangular frame by inserting said tenons into said mortises.

4. A system as set forth in claim 3 wherein each of said frame members includes a mortise on one of said ends thereof and a tenon on the opposite one of said ends.

5. A system as set forth in claim 3 wherein two of said frame members include at least one mortise on each of said ends thereof and the other two of said frame members includes at least one tenon on each of said ends thereof.

6. A system as set forth in claim 3 wherein said tenons and said mortises extend in the same direction as said angled end.

7. A system as set forth in claim 3 wherein said tenons each extend at generally at a right angle with respect to said frame member, and said mortises each extend generally in the same direction as said frame member.

8. A system as set forth in claim 1 wherein said frame members include a flat front surface, said front flat surface including a plurality of said receiving holes.

9. A system as set forth in claim 8, wherein said clamping members include a bottom flat surface, said bottom flat surface including a plurality of pegs adapted for engagement with said receiving holes.

10. A system as set forth in claim 9 wherein, said frame members further include a shoulder extending from said flat front surface, said shoulder and said front flat surface defining a channel for receiving said clamping members.

11. A system as set forth in claim 1, wherein said sheet material comprises a poster or protective cover.

12. A framing system for mounting or displaying a poster or other sheet material comprising:

frame members adapted to be secured together to form a base structure, said frame members being detachably connectable together such that they can be connected to each other to form said base structure as an open frame and can be subsequently disassembled by disconnecting said frame members from each other; and a clamping structure adapted for engagement with said base structure to retain the sheet material therebetween, said clamping structure including a plurality of individual clamping members that attach to said frame members, said clamping structure further including pegs on one of said frame members and said clamping members and corresponding receiving holes on the other of said frame members and said clamping members, said receiving holes being adapted to receive said pegs to retain the sheet material between said clamping members and said frame members;

wherein said base structure comprises four frame members each of said frame members extending between a pair of inwardly angled ends, and each of said angled ends adapted to be connected to an adjacent complementary end of another of said frame members;

wherein some of said ends of said frame members include a tenon and others of said ends of said frame members include a mortise, and wherein said frame members can be interconnected to form a rectangular frame by inserting said tenons into said mortises; and wherein each of said tenons and said mortises includes one of said receiving holes which are aligned when said tenon and said mortise are in mating engagement, and wherein said aligned holes are adapted to receive one of said pegs to thereby secure adjacent frame members together.

13. A framing system comprising:

frame members adapted to be secured together to form a base structure, said frame members being detachably connectable together such that they can be connected to each other to form said base structure as an open frame and can be subsequently disassembled by disconnecting said frame members from each other;

a clamping structure adapted for engagement with said base structure to retain the sheet material therebetween, said clamping structure including a plurality of individual clamping members that attach to said frame members, said clamping structure further including pegs on one of said frame members and said clamping members and corresponding receiving holes on the other of said frame members and said clamping members, said receiving holes being adapted to receive said pegs to retain the sheet material between said clamping members and said frame members; and a protective cover adapted for disposition between said frame members and said clamping members, said protective cover including a plurality of holes therethrough at the periphery thereof for receiving the pegs to thereby secure said protective cover between said frame members and said clamping members.

14. A framing system comprising:

frame members adapted to be secured together to form a base structure, said frame members being detachably connectable together such that they can be connected to each other to form said base structure as an open frame and can be subsequently disassembled by disconnecting said frame members from each other;

a clamping structure adapted for engagement with said base structure to retain the sheet material therebetween said clamping structure including a plurality of individual clamping members that attach to said frame members, said clamping structure further including pegs on one of said frame members and said clamping members and corresponding receiving holes on the other of said frame members and said clamping members, said receiving holes being adapted to receive said pegs to retain the sheet material between said clamping members and said frame members; and a poster adapted for disposition between said frame members and said clamping members, said poster including a plurality of holes therethrough at the periphery thereof for receiving said pegs to thereby secure said poster between said frame members and said clamping members.

15. A framing system for mounting or displaying a poster or other sheet material comprising:

a plurality of frame members that interconnect to form a base structure, each frame member having a pair of ends with each end interconnecting with an end of another of said frame members to form said base structure as an open frame; and a plurality of separate clamping members each being individually attachable directly to said base structure to retain the sheet material between said base structure and said clamping members, wherein said clamping members secure adjacent frame members together when connected with said base structure.

16. A system as set forth in claim 15 wherein said base structure comprises four frame members, each of said frame members extending between a pair of inwardly angled ends, and each of said angled ends adapted to be connected to an adjacent complementary end of another of said frame members.

17. A system as set forth in claim 16 further including pegs on one of said frame members and said clamping members and corresponding receiving holes on the other of said frame members and said clamping members, said receiving holes being adapted to receive said pegs to retain the sheet material between said clamping members and said frame members.

18. A system as set forth in claim 17 wherein some of said ends of said frame members include a tenon and others of said ends of said frame members include a mortise, and wherein said frame members can be interconnected to form a rectangular frame by inserting said tenons into said mortises.

19. A system as set forth in claim 18 wherein each of said frame members includes a mortise on one of said ends thereof and a tenon on the opposite one of said ends.

20. A system as set forth in claim 18 wherein two of said frame members include at least one mortise on each of said ends thereof and the other two of said frame members includes at least one tenon on each of said ends thereof.

21. A system as set forth in claim 18 wherein said tenons and said mortises extend in the same direction as said angled end.

22. A system as set forth in claim 18 wherein said tenons each extend at generally at a right angle with respect to said frame member, and said mortises each extend generally in the same direction as said frame member.

23. A system as set forth in claim 15 wherein said frame members include a flat front surface, said front flat surface including a plurality of receiving holes.

24. A system, as set forth in claim 23 wherein said clamping members include a bottom flat surface, said bottom flat surface including a plurality of pegs adapted for engagement with said receiving holes.

25. A system as set forth in claim 24 wherein said frame members further include a shoulder extending from said flat front surface, said shoulder and said front flat surface defining a channel for receiving said clamping members.

26. A system as set forth in claim 24 further including a protective cover adapted for disposition between said frame members and said clamping members, said protective cover including a plurality of holes therethrough at the periphery thereof for receiving the pegs to thereby secure said protective cover between said frame members and said clamping members.

27. A system as set forth in claim 24 further including a poster adapted for disposition between said frame members and said clamping members, said poster including a plurality of holes therethrough at the periphery thereof for receiving said pegs to thereby secure said poster between said frame members and said clamping members.

28. A framing system for mounting or displaying a poster or other sheet material comprising:

a plurality of frame members that interconnect to form a base structure, each frame member having a pair of ends with each end interconnecting with an end of another of said frame members to form said base structure as an open frame; and a plurality of separate clamping members each being individually attachable directly to said base structure to retain the sheet material between said base structure and said clamping members, wherein said base structure comprises four frame members, each of said frame members extending between a pair of inwardly angled ends, and each of said angled ends adapted to be connected to an adjacent complementary end of another of said frame members;

wherein said framing system further includes pegs on one of said frame members and said clamping members and corresponding receiving holes on the other of said frame members and said clamping members, said receiving holes being adapted to receive said pegs to retain the sheet material between said clamping members and said frame members;

wherein some of said ends of said frame members include a tenon and others of said ends of said frame members include a mortise, and wherein sand frame members can be interconnected to form a rectangular frame by inserting said tenons into said mortises; and wherein each of said tenons and said mortises includes one of said receiving holes which are aligned when said tenon and said mortise are in mating engagement, and wherein said aligned holes are adapted to receive one of said pegs to thereby secure adjacent frame members together.

29. A kit for making a framed display comprising:

a canister comprising a generally tubular canister body;

a plurality of separate frame members adapted to be secured together to form a base structure;

a sheet material having holes about the periphery of said sheet material; and a plurality of separate clamping members adapted for independent detachable connection with said base structure through said holes in said sheet material to retain said sheet material between said base structure and said clamping members;

wherein said frame members, sheet material, and clamping members are disposed within said canister.

30. A kit as set forth in claim 29 wherein said sheet material comprises a poster, and wherein said kit further includes a protective cover contained within said canister and sized relative to said poster such that said protective cover can overlie said sheet material while being retained between said base structure and said clamping member.

31. A kit as set forth in claim 29 further including a stopper to separate said canister into first and second volumes, wherein said frame members and said clamping members are in said first volume.

32. A kit as set forth in claim 29 further including a novelty item in said second volume.

33. A kit as set forth in claim 29, further comprising at least one endcap connected to an end of said tubular canister and enclosing said frame members, sheet material, and clamping members within said canister.

34. A kit as set forth in claim 29, wherein said sheet material comprises a protective cover.

35. A kit for making a framed display containing a poster or other sheet material comprising:

a canister comprising a generally tubular canister body;

a plurality of separate frame members adapted to be secured together to form a base structure;

a sheet material; and a plurality of separate clamping members adapted for independent detachable connection with said base structure to retain said sheet material between said base structure and said clamping members;

wherein said frame members, sheet material, and clamping members are disposed within said canister; and wherein said clamping members secure adjacent frame members together when connected with said base structure.

36. A kit as set forth in claim 35 wherein said base structure comprises four frame members, each of said frame members extending between a pair of inwardly angled ends, and each of said angled ends adapted to be connected to an adjacent complementary end of another of said frame members.

37. A kit as set forth in claim 36 further including pegs on one of said frame members and said clamping members and corresponding receiving holes on the other of said frame members and said clamping members, said receiving holes being adapted to receive said pegs to retain the sheet material between said clamping members and said frame members.

38. A kit as set forth in claim 37 wherein some of said ends of said frame members include a tenors and others of said ends of said frame members include a mortise, and wherein said frame members can be interconnected to form a rectangular frame by inserting said tenons into said mortises.

39. A kit as set forth in claim 38 wherein each of said tenons and said mortises includes one of said receiving holes which are aligned when said tenon and said mortise are in mating engagement, and wherein said aligned holes are adapted to receive one of said pegs to thereby secure adjacent frame members together.

40. A kit as set forth in claim 38 wherein each of said frame members includes a mortise on one of said ends thereof and a tenon on the opposite one of said ends.

41. A kit as set forth in claim 38 wherein two of said frame members include at least one mortise on each of said ends thereof and the other two of said frame members includes at least one tenon on each of said ends thereof.

42. A kit as set forth in claim 38 wherein said tenons and said mortises extend in the same direction as said angled end.

43. A kit as set forth in claim 38 wherein said tenons each extend at generally at a right angle with respect to said frame member, and said mortises each extend generally in the same direction as said frame member.

44. A kit for making a framed display containing a poster or other sheet material comprising:

a canister comprising a generally tubular canister body;

a plurality of separate frame members adapted to be secured together to form a base structure;

a sheet material; and a plurality of separate clamping members adapted for independent detachable connection with said base structure to retain said sheet material between said base structure and said clamping members;

wherein said frame members, sheet material, and clamping members are disposed within said canister; and wherein said frame members include a recessed flat front surface.

45. A kit as set forth in claim 44 wherein said clamping members include a bottom flat surface, wherein, for each of said frame members and said clamping members, one of said front flat surface and said bottom flat surface includes a plurality of receiving holes and the other of said front flat surface and said bottom flat surface including a plurality of pegs adapted for engagement with said receiving holes.

46. A kit as set forth in claim 45 wherein said frame members further include a shoulder extending from said flat front surface, said shoulder and said front flat surface defining a channel for receiving said clamping members.

47. A kit as set forth in claim 45 further including a protective cover adapted for disposition between said frame members and said clamping members, said protective cover including a plurality of holes therethrough at the periphery thereof for receiving the pegs to thereby secure said protective cover between said frame members and said clamping members.

48. A kit as set forth in claim 45 wherein said sheet material comprises a poster adapted for disposition between said frame members and said clamping members, said poster including a plurality of holes therethrough at the periphery thereof for receiving said pegs to thereby secure said poster between said frame members and said clamping members.

49. A kit for making a framed display of a poster or other sheet material, comprising:

a plurality of elongated frame members each having first and second ends that mate with complementary ends of another of said frame members, wherein said frame members can be connected together at said ends to form an open frame;

a sheet material sized to fit within said frame and including holes located at the periphery of said sheet material;

a plurality of pegs sized to fit within said holes;

a plurality of elongated clamping members, wherein said clamping members can be attached via said pegs to said open frame with said pegs extending through said holes to thereby clamp said sheet material to said frame; and a tubular canister containing said frame members, said sheet material, said pegs, and said clamping members.

50. A kit as set forth in claim 49, wherein said pegs comprise unitary portions of said clamping members.

51. A framing system for a poster or other sheet material, comprising:

a plurality of elongated frame members each having a pair of ends, some of said ends being mortised and others of said ends having a tenon that fits within one or more of said mortises to thereby form a mortise and tenon joint, wherein said frame members can be connected together at said ends to form an open frame having one of said mortise and tenon joints at each end of each of said frame members;

said mortises and said tenons each having a laterally extending through-hole, wherein said through-hole of each tenon aligns with said through-hole of an associated one of said mortises when said frame members are connected together by said joints to form said open frame; and a plurality of clamping members that can be attached to said frame members, wherein at least some of said clamping members include a peg, with said pegs extending into said aligned through holes at each of said joints to thereby prevent each of said tenons from detaching from its associated mortise.

* * * * *